United States Patent [19]

Sato et al.

[11] Patent Number: 4,633,654

[45] Date of Patent: Jan. 6, 1987

[54] AIR EXTRACTOR FOR BAG MAKING, FILLING AND PACKAGING MACHINE

[75] Inventors: Minoru Sato, Funabashi; Takayuki Kanai, Matsudo, both of Japan

[73] Assignee: Tokyo Automatic Machinery Works, Ltd., Tokyo, Japan

[21] Appl. No.: 628,908

[22] Filed: Jul. 9, 1984

[51] Int. Cl.[4] ..... B65B 31/04; B65B 9/20

[52] U.S. Cl. ..... 53/511; 53/526; 53/551

[58] Field of Search ..... 53/86, 511, 512, 523, 53/526, 527, 551, 552, 554

[56] References Cited

U.S. PATENT DOCUMENTS

| | | | |
|---|---|---|---|
| 1,980,022 | 11/1934 | Whitehouse | 53/511 X |
| 2,113,636 | 4/1938 | Vogt | 53/551 X |
| 2,145,941 | 2/1939 | Maxfield | 53/511 X |
| 3,040,490 | 6/1962 | Virta | 53/551 X |
| 3,471,990 | 10/1969 | Bonuchi et al. | 53/512 X |
| 3,545,983 | 12/1970 | Woods | 53/451 X |
| 3,634,993 | 1/1972 | Pasco et al. | 53/511 X |
| 4,215,524 | 8/1980 | Saylor | 53/554 |

*Primary Examiner*—Fred Silverberg
*Assistant Examiner*—Michael D. Folkerts
*Attorney, Agent, or Firm*—Watson, Cole, Grindle & Watson

[57] ABSTRACT

This invention relates to an air extractor for a bag-making filling and packaging machine for exhausting the air in a bag filled with goods. The air extractor comprises frames freely closing and opening for surrounding in an air-tight manner the bag filled with the goods. Air is supplied into the closed frames so as to squeeze the outer surfaces of the bag by the pressure of the supplied air to extract the air from the bag. In this manner, the air in the bag is reliably extracted irrespective of the shapes of the goods and their filled conditions without damaging the goods.

2 Claims, 8 Drawing Figures

AIR EXTRACTOR FOR BAG MAKING, FILLING AND PACKAGING MACHINE

BACKGROUND OF THE INVENTION

1. Field of the Invention

This invention relates to an air extractor for a bag-making filling and packaging machine which includes a bag making cylinder about which a packaging film is wound to form a downwardly hanging bag, which is then filled with goods through the cylinder, and a sealing device for sealingly melting an upper portion of the bag and cutting off the bag.

2. The Prior Art

In order to extract the air in a bag filled with goods in such a packaging machine, there has often been provided embracing pieces made of a sponge or the like adapted to be closed and opened in the proximity of the bag for extracting the air in the bag being squeezed by the pieces. Accordingly, the extraction of the air has not been sufficiently effected owing to the particular shapes and filled conditions of the goods. Moreover, the extracted extent of the air cannot be adjusted, while the embracing pieces are likely to damage fragile goods such as potato chips or fried, sliced potatoes.

SUMMARY OF THE INVENTION

It is a primary object of the invention to provide an improved air extractor for a bag-making, filling and packaging machine which eliminates the above-mentioned disadvantages of the prior art which reliably extracts the air in bags irrespective of shapes and filled conditions of the goods in the bags.

It is another object of the invention to provide an air extractor for the above-mentioned packaging machine which is capable of extracting the air in the bags without damaging the goods therein, i.e., in the event that the goods are fragile.

It is a further object of the invention to provide an air extractor which can be adjusted to control degree to which the air is extracted.

It is an additional object of the invention to provide an air extractor of the above kind packaging machine which is able of shortening the time required to extract the air in the bag, thereby improving its operative performance.

In order to achieve these objects, the air extractor according to the invention comprises two frames arranged in opposition to each other to be freely closed and opened and sealingly enclosing the bag filled with the goods when closed, and air supply means for supplying the air into the closed frames to squeeze the outer surfaces of the bag, the frames being formed at their mating surface with at least one air vent.

According to the invention, all the outer surfaces of the bag are uniformly squeezed without intensely pressing the goods in the bag so as to prevent damage to even fragile goods such as potato chips. Moreover, the air extractor according to the invention is capable of controlling the degree to which air is extracted by adjusting the amount of air supplied into the frames.

Furthermore, there may be provided in the frames one or more elastomers to form recesses between the bag and the elastomers at will, thereby reducing spaces to be supplied with the air to effect rapid air extracting operation.

The invention will be more fully understood by referring to the following detailed specification and claims taken in connection with the appended drawings.

DESCRIPTION OF THE PREFERRED EMBODIMENTS

Figure 1:
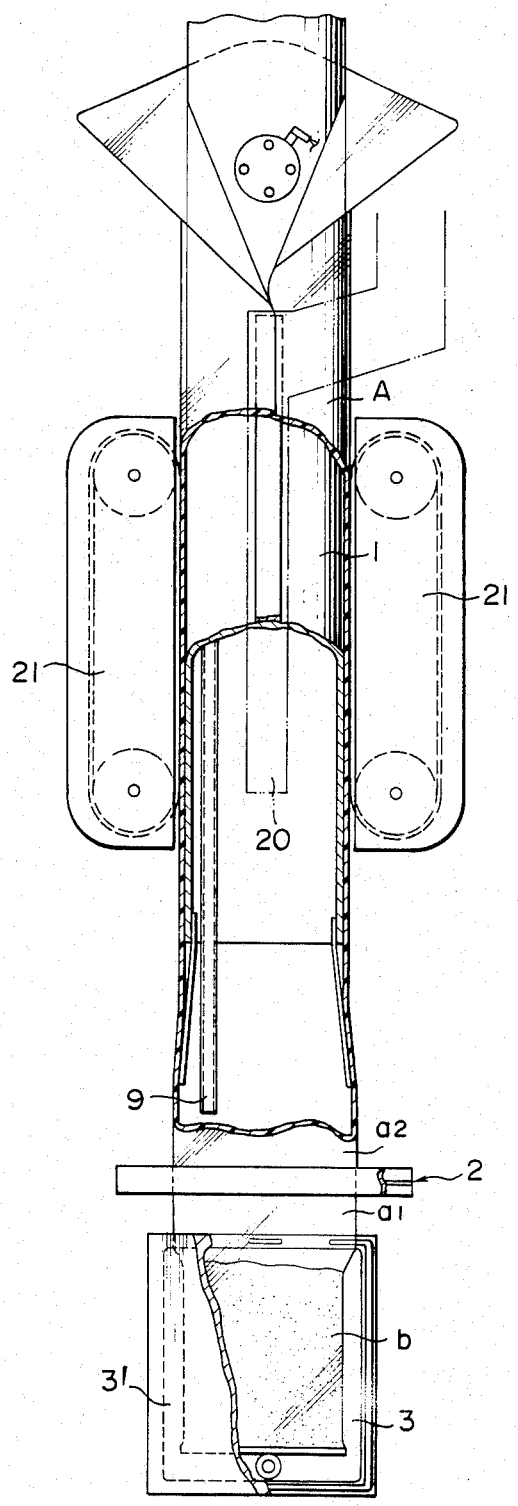
FIG. 1 is a front elevation, partially broken away, of a bag making filling packaging machine according to the invention.
Figure 2:
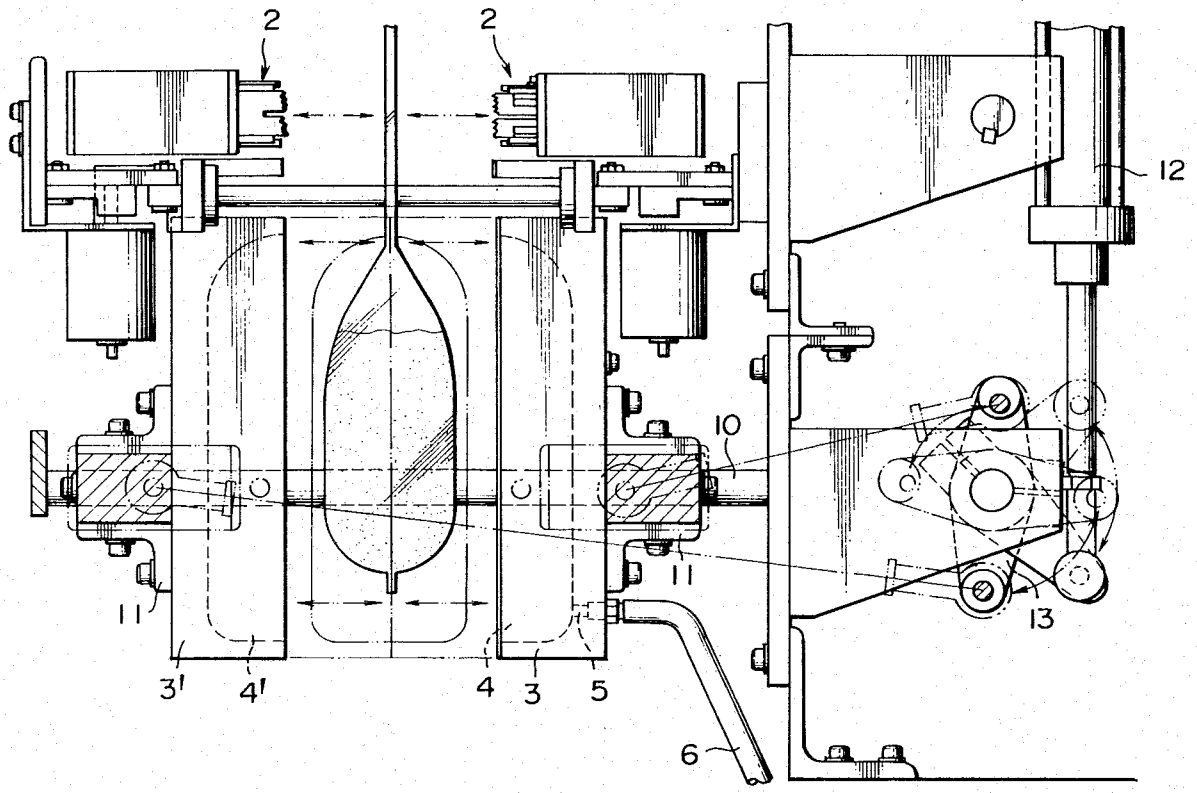
FIG. 2 is a side view, partially broken away, of the air extractor for the machine shown in FIG. 1.

Referring to FIGS. 1–5, a packaging machine according to the invention comprises a bag-making cylinder 1 about which a packaging film A is wound and a longitudinal sealing device 20 for longitudinally sealing the film to form a tubular bag blank hanging thereat. Belt conveyors 21 are arranged on both sides of the bag-making cylinder 1, respectively, and brought into contact with the packaging film to feed it intermittently in increments of a length of a bag $a_1$.

Above the bag-making cylinder 1 is provided a hopper (not shown) for filling goods into a bag through the bag making cylinder 1. Under the bag-making cylinder 1 is provided a sealing device 2 adapted to be closed and opened. The sealing device 2 comprises heaters at its lower and upper portions for sealing an opening of a bag $a_1$ and a bottom of a bag $a_2$ and a separating mechanism at its mid portion for separating the bag $a_1$ from the bag $a_2$.

The above bag-making cylinder 1 is provided therein with an exhaust pipe 9 having a suction port located in the proximity of the sealing device 2 and adapted to be cooperated with an air extractor explained hereinafter.

Figure 3:
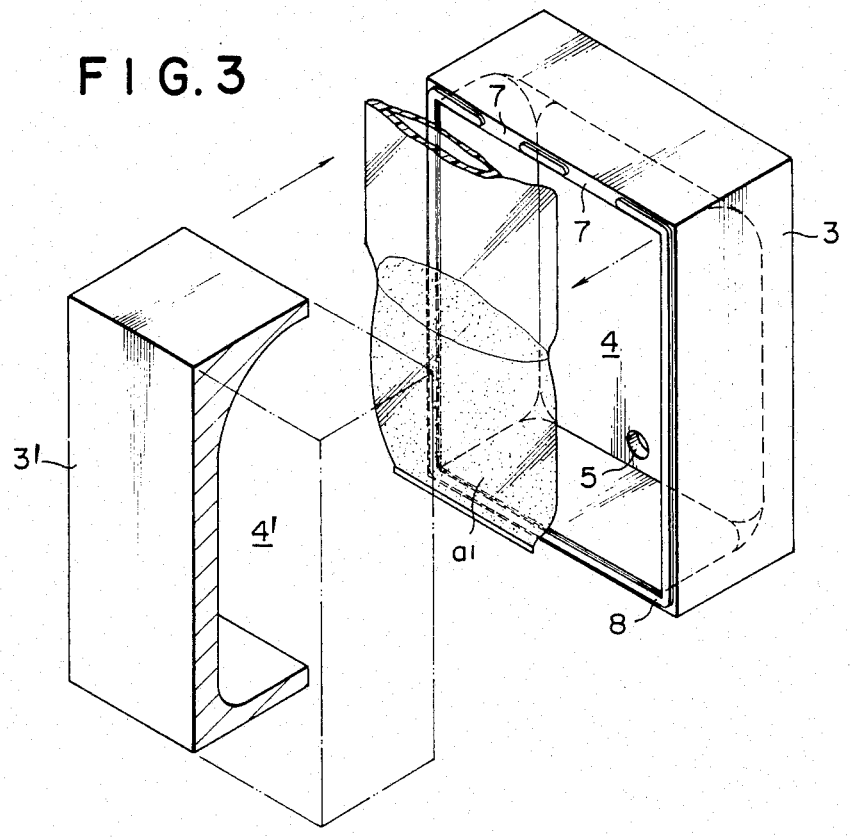
FIG. 3 is an exploded perspective view of the air extractor shown in FIG. 2.

The air extractor comprises frame 3 and 3' having bag housing portions 4 and 4', respectively, and arranged on both sides of the bag $a_1$ so as to be able to close and open with each other. A rubber seal 8 is attached to a circumferential periphery 4 of the frame 3 to afford a tight sealing when the frames 3 and 3' are closed. The rubber seal 8 is formed with notches to form air vents 7 (FIG. 3).

The frame 3 is formed in its rear portion with an air inlet 5 connected to an air supply pipe 6 for supplying the air into the frames 3 and 3'. The other end of air supply pipe 6 is connected to an air circuit of the packaging machine. In this embodiment, the air is supplied in response to the closing of the frames 3 and 3'. However, the air may be always supplied.

A closing and opening mechanism for the frames 3 and 3' comprises guide rods 10 arranged on both sides of the frames 3 and 3', respectively, mounting members 11 slidably fitted on the guide rods 10 and carrying thereon the frames 3 and 3', and driving arms 13 connected through connecting rods to the mounting members 11 and driven by a driving cylinder 12 for closing an opening the frames 3 and 3'.

Figure 4:
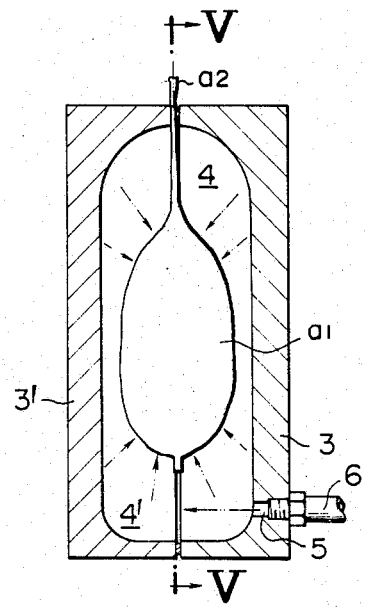
FIG. 4 is a sectional side view of frames of the air extractor under an air extracting condition according to the invention.
Figure 5:
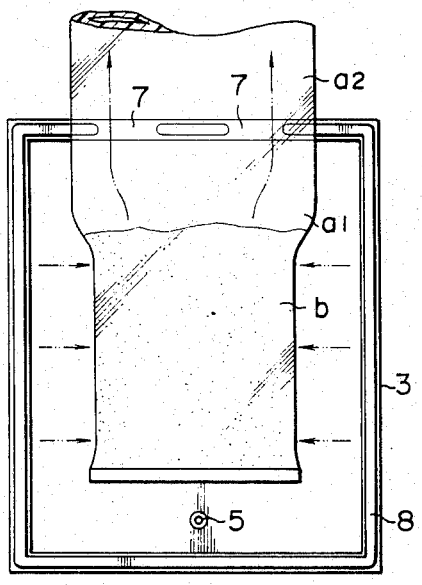
FIG. 5 is a sectional view of the frames taken along the line V—V in FIG. 4.

The operation of the packing machine of this embodiment will now be explained. First, goods b are filled through the bag-making cylinder 1 into the bag $a_1$. Thereafter, the frames 3 and 3' are closed. Then air is supplied through the air supply pipe 6 and the inlet 5 into the internal chamber formed by the frames 3 and 3'. Owing to the pressure of the supplied air, as shown in FIGS. 4 and 5 the bag $a_1$ is circumferentially uniformly squeezed to exhaust the air in the bag $a_1$ through clearances formed by the air vents 7 on the side of the opening of the bag $a_1$.

The air extruded from the bag $a_1$ is exhausted out of the cylinder 1 through the exhaust pipe 9.

The exhaust pipe 9 is connected to a vacuum or suction mechanism so as to force the air from the bag $a_1$ and the frames 3 and 3' out of the cylinder, thereby remarkably improving the air extracting effect of the machine.

The exhaust pipe 9 is not essential for the invention. The air may be exhausted through the cylinder 1 naturally or unforcedly.

At the moment when the air in the bag $a_1$ has been extracted, the sealing devices 2 are closed to seal the opening and bottom of the bag $a_1$. Therefore the bag $a_1$ is cut off.

Then the sealing devices 2 and the frames 3 and 3' are opened to drop the bag $a_1$ downward. Then the belt conveyors 21 are driven to move the bag $a_2$ into the position where the bag $a_1$ has assumed. Then the above operation is repeated.

In the above embodiment, the extent to which air is extracted from the bag $a_1$ can by changed at will be adjusting the time when the frames 3 and 3' are closed or the amount of air to be supplied into the frames. Moreover, the mechanism for extracting the air in the bag is advantageously simple because an existing air circuit for the bag-making filling and packaging machine is utilized to extrude the air from the bag.

Figure 6:
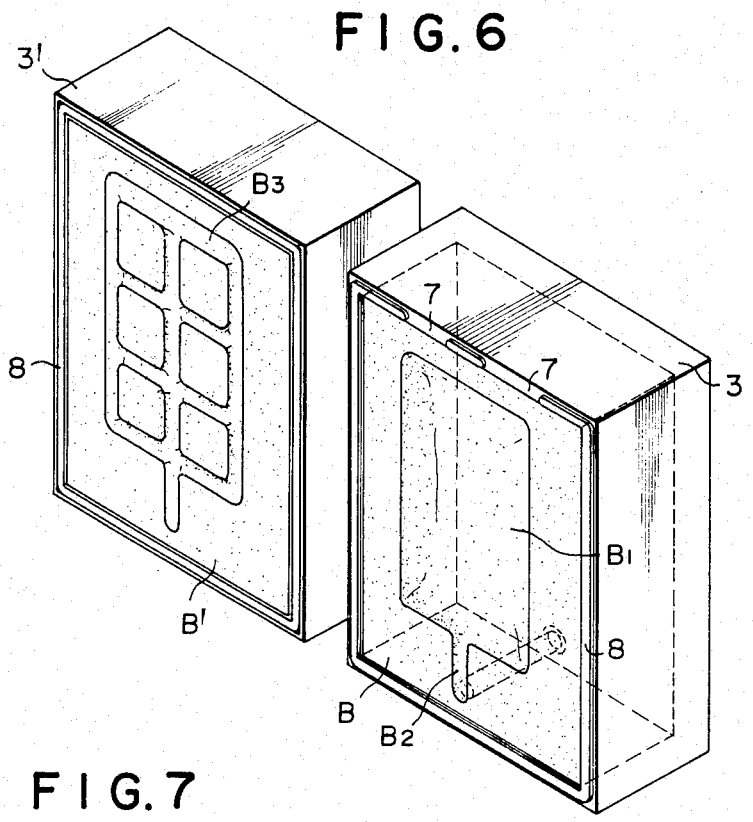
FIG. 6 is an exploded perspective view of another embodiment of the air extractor according to the invention.
Figure 7:
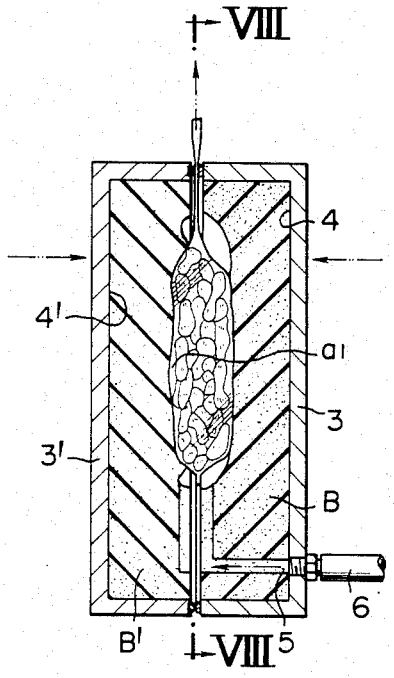
FIG. 7 is a sectional side view of the extractor shown in FIG. 6 under an air extracting condition.
Figure 8:
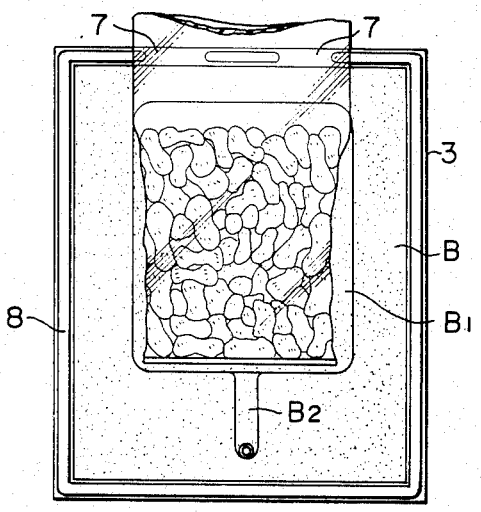
FIG. 8 is a sectional view of the extractor taken along the line VIII—VIII in FIG. 7.

FIGS. 6–8 illustrate another embodiment of the air extractor. It comprises flexible elastomers B and B' located in the frames 3 and 3' wherein like members have been designated by the same reference numerals as those in the previous embodiment for the sake of convenience and detailed explanation for the like members will be omitted.

The flexible elastomer B to be located in a cavity 4 of the frame 3 is made of a sponge or the like to form a recess $B_1$ for accommodating the bag $a_1$ and is formed with an air passage $B_2$ communicating with the recess $B_1$ and leading to an air inlet 5. The flexible elastomer B' to be arranged in a bag receiving cavity 4' of the frame 3' is also made of a sponge or the like and is formed with air passages $B_3$ in the form of a grid extending all over the bag $a_1$. In operation, the bag $a_1$ is squeezed by the flexible elastomers B and B' to initially extract the air from the bag $a_1$ and the recess $B_1$ and the air passages $B_2$ and $B_3$ forming air supply spaces become narrow spaces, so that the air in the bag $a_1$ can be extracted by the air supply for a short period of time, thereby shortening the time required for the air extraction.

Moreover, the flexible elastomer B' may be devoid of the air passages $B_2$ and $B_3$ or may be formed with the recess $B_1$ similar to that of the flexible elastomer B.

While the invention has been particularly shown and described with reference to preferred embodiments thereof, it will be understood by those skilled in the art that the foregoing and other changes in form and details can be made therein within departing from the spirit and scope of the invention.

We claim:

1. In an apparatus for forming, filling and closing a series of bags, said apparatus including a bag-making cylinder around which a film can be wrapped to form a tube as the film passes along the length of said bag-making cylinder in a downstream direction and through the interior of which the articles intended to be contained in each bag can flow, a sealing means sealingly located adjacent the downstream end of said bag-making cylinder for closing the open top of a downstream bag and closing the bottom of an adjacent upstream bag, and an air extractor for removing air from within a bag which contains articles prior to the closing of its open top, the improvement wherein said air extractor means comprises an exhaust pipe which extends along the interior of said bag-making cylinder to its downstream end, and two frames which are positioned downstream of said sealing means and are movable toward and away from each other between an open position wherein a bag in which articles have been deposited can be positioned therebetween and a closed position wherein they provide an internal chamber in which a bag containing articles can be located, said two frames being sealingly connected to said sealing means when in their closed position, said two frames having mating surfaces; wherein one of said two frames includes a rubber seal on its mating surface which abuts the mating surface of the other of said two frames when in their closed position, said rubber seal being discontinuous on a side of said one frame facing said sealing means to provide a vent passage which, when vacuum is applied to said exhaust pipe, allows air from within a bag positioned in said internal chamber to flow therethrough and into said exhaust pipe; wherein one of said two frames contains a flexible elastomer therein which includes groove-shaped air passages arranged in a grid and an inlet opening which communicates with said air passages to enable pressurized air to flow into said groove-shaped air passages, and wherein the other of said two frames contains a flexible elastomer which provides a recess therein which helps constitute said internal chamber.

2. An apparatus as defined in claim 1, wherein said flexible elastomers in each of said two frames is made of sponge.

* * * * *